US008146745B2

(12) United States Patent
Burress et al.

(10) Patent No.: US 8,146,745 B2
(45) Date of Patent: Apr. 3, 2012

(54) ENVIRONMENTALLY SEPARABLE PACKAGING DEVICE WITH ATTACHING BASE

(75) Inventors: Stephen E. Burress, Aurora, OH (US); Ralph W. Kilbort, Wellington, OH (US); James J. Mattiucci, Wakefield, RI (US)

(73) Assignee: CardPak, Inc., Solon, OH (US)

( * ) Notice: Subject to any disclaimer, the term of this patent is extended or adjusted under 35 U.S.C. 154(b) by 0 days.

(21) Appl. No.: 12/045,378

(22) Filed: Mar. 10, 2008

(65) Prior Publication Data

US 2008/0217199 A1 Sep. 11, 2008

Related U.S. Application Data

(60) Provisional application No. 60/906,104, filed on Mar. 9, 2007.

(51) Int. Cl.
*B65D 73/00* (2006.01)

(52) U.S. Cl. ..... 206/462; 206/470; 206/471

(58) Field of Classification Search ..... 206/470, 206/471, 461, 469, 451, 462, 463, 464, 762–764
See application file for complete search history.

(56) References Cited

U.S. PATENT DOCUMENTS

| | | | | | |
|---|---|---|---|---|---|
| 2,945,586 | A * | 7/1960 | Mackes | 206/470 |
| 4,261,462 | A * | 4/1981 | Wysocki | 206/463 |
| 4,485,920 | A * | 12/1984 | Skylvik | 206/468 |
| 4,499,353 | A * | 2/1985 | Shields | 206/470 |
| 4,694,960 | A * | 9/1987 | Phipps et al. | 206/469 |
| 4,784,268 | A * | 11/1988 | Perchak | 206/461 |
| 4,903,838 | A * | 2/1990 | Broers et al. | 206/459.5 |
| 4,930,627 | A * | 6/1990 | Borst et al. | 206/45.23 |
| 6,401,932 | B1 * | 6/2002 | Weinstein et al. | 206/779 |
| 7,207,441 | B2 * | 4/2007 | Ritter | 206/470 |
| 7,621,400 | B2 * | 11/2009 | Smith et al. | 206/470 |
| 2003/0217949 | A1 * | 11/2003 | Schamante | 206/705 |
| 2007/0029223 | A1 * | 2/2007 | Mazurek | 206/463 |
| 2007/0051653 | A1 * | 3/2007 | Tilton | 206/462 |

* cited by examiner

*Primary Examiner* — Mickey Yu
*Assistant Examiner* — Chun Cheung
(74) *Attorney, Agent, or Firm* — Daniel J. Schlue; Roetzel & Andress

(57) ABSTRACT

The present invention generally relates to a bubble package which allows a product to be displayed independently standing alone or hanging from a bracket/shelf, and also provides the ability to separate the paper and plastic portions of the package into at least two separate environmentally recycled portions. The paper based portion of the package operates as a display card and/or as a stiffener. The sides of the one or more display cards are bonded to one another to enclose the product within the plastic and prevent tampering with the product. The plastic portion, in addition to containing and displaying the product therein, optionally incorporates a base near the bottom of the package. The base protrudes from the bottom of the package and secures back onto the plastic portion via a securing mechanism. This arrangement allows the package to stand independent. Optionally, a corrugated plastic insert can be used to provide additional support to the unit. In a typical arrangement, the plastic portions and paper portions avoid being bonded or directly adhered to one another, allowing the card to be entirely separable and allowing for complete environmental recyclability.

27 Claims, 4 Drawing Sheets

ENVIRONMENTALLY SEPARABLE PACKAGING DEVICE WITH ATTACHING BASE

RELATED APPLICATION DATA

This application claims priority to previously filed U.S. Provisional Patent Application No. 60/906,104, entitled "Environmentally Separable Hinged Clam-Shell Packaging Device with Corrugated Insert", and filed Mar. 9, 2007, which is hereby incorporated in its entirety by reference.

FIELD OF THE INVENTION

The present invention generally relates to a package which allows a product to be displayed. In one embodiment, the package of the present invention can stand alone independently or can be hanged from a bracket or shelf. In another embodiment, the package of the present invention is able to be separated into its component parts so that such parts can be, if so required, independently recycled. In still another embodiment, due to its ability to be separated the package of the present invention can comprise various components formed from dissimilar materials (e.g., paper and plastic).

BACKGROUND OF INVENTION

Blister or clam shell packages have long been used for packaging a wide variety of products and for displaying these products for sale in retail stores. The package is typically designed to conform to the configuration of the article contained therein. Such blisters/calm-shells, after filling, are bonded to supporting paper cards and can either be hung from a rack or if a stand-up type mechanism is utilized can be displayed on a shelf or table. Current stand up displays pose environmental recycling problems as typically the package is not completely separable/deconstructable. Typically, the bonding of the plastic to the card results in a plastic which is contaminated with paper/cardboard.

In recent years, the number and variety of products packaged and displayed in blister-type and clam shell type packaging has greatly increased. Part of this increase is due to the popularity of warehouse shopping centers. Such blister and clam-shell packages have found wide use in retail stores and warehouse centers as they display each item and also protect the product inside from tampering. As such, the displays should be pilfer-resistant, meaning one cannot easily shoplift, or steal, the product contained therein without first removing the item from the package or in the alternate by shoplifting the entire bulky package.

The hanging display, once predominantly used in the industry, has yielded portions of the market to alternative types of displays. The proliferation of warehouse stores/centers has required the use of a variety of standup displays. U.S. Pat. No. 4,784,268 details a standalone device which discloses a standard blister card on a shelf, eliminating the need for hanging the package. The patent discloses a stand-alone device which bonds plastic to a cardstock. The drawback to this setup is that this bonding/adhering between plastic and cardstock contaminates the plastic and thereby renders it unsuitable for a recycling process.

In recent years, several major warehouse centers and retail outlets have undertaken environmentally friendly and/or green programs regarding recycling. These programs promote the use of environmentally friendly packaging and has necessitated the need for more environmentally friendly packaging designs. Thus, there is a need in the art for a package that not only has the ability stand independently, but also one that is more readily recycled.

SUMMARY OF INVENTION

The present invention generally relates to a package which allows a product to be displayed. In one embodiment, the package of the present invention can stand alone independently or can be hanged from a bracket or shelf. In another embodiment, the package of the present invention is able to be separated into its component parts so that such parts can be, if so required, independently recycled. In still another embodiment, due to its ability to be separated the package of the present invention can comprise various components formed from dissimilar materials (e.g., paper and plastic).

In one embodiment the present invention relates to a de-constructable package comprising: a front, a back, a base, and at least one insert, wherein the at least one insert has a top edge, a bottom edge, and at least one cavity, wherein the front, the back, the base and the at least one insert together form a de-constructable package, and wherein the combination of the base and the at least one insert permit the de-constructable package to stand independently.

In another embodiment the present invention relates to a de-constructable package comprising: a front, a back, a base, and at least one clamshell insert, wherein the at least one insert has a top edge, a bottom edge, and at least one cavity, wherein the front, the back, the base and the at least one insert together form a de-constructable package, and wherein the combination of the base and the at least one insert are integrally formed and permit the de-constructable package to stand independently.

In another embodiment the present invention relates to a method for forming a de-constructable package comprising: providing a front, providing a back, providing a base, providing at least one insert, wherein the at least one insert has a top edge, a bottom edge, and at least one cavity, and securing the front, the back, the base and the at least one insert together to form a de-constructable package, wherein the combination of the base and the at least one insert permit the de-constructable package to stand independently.

In another embodiment the present invention relates to a display package formed from cardstock and a plastic type material, the package being able to be hung or displayed on a shelf or other suitable means wherein the package can be completely recycled.

DETAILED DESCRIPTION OF THE INVENTION

Figure 1:
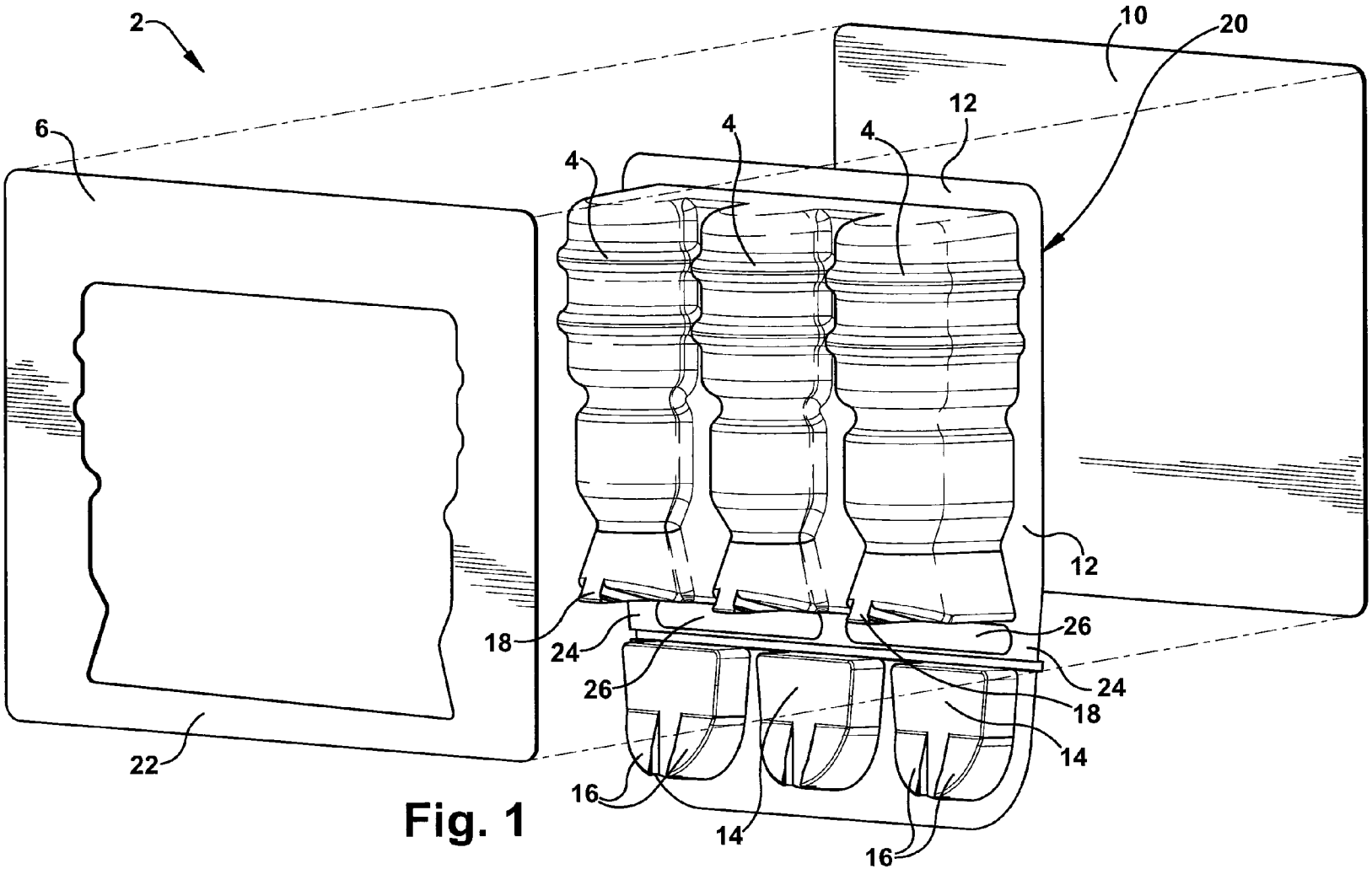
FIG. 1 is an exploded view of a package according to one embodiment of the present invention.

The present invention generally relates to a package which allows a product to be displayed. In one embodiment, the package of the present invention can stand alone independently or can be hanged from a bracket or shelf. In another embodiment, the package of the present invention is able to be separated into its component parts so that such parts can be, if so required, independently recycled. In still another embodiment, due to its ability to be separated the package of the present invention can comprise various components formed from dissimilar materials (e.g., paper and plastic).

In one embodiment, the present invention provides a display package which can stand alone on a shelf, or table, or can be hung via a suitable bracket or holder. In another embodiment, the plastic and paper portions can be separated for recycling. In one embodiment the plastic and paper portions are not directly bonded to one another, thereby permitting easy separation of the two portions. In another embodiment the plastic and paper portions are compressed together, again allowing for separation of the two portions. Another embodiment of a package in accordance with the present invention includes a plastic insert located between at least two paper-based pieces such that the combination of the at least three pieces forms a package that can stand independently and is easily recyclable. In one instance, the plastic insert is designed to contain hinged base located at the bottom of the package that permits the plastic insert to wrap around one or more portions of at least one of the paper-based pieces. Such a design can include a continuous piece of plastic formed around a bottom strip of at least one of the paper-based pieces of the package thereby permitting the package to stand, without requiring the plastic shell portion to directly attach, adhere or be glue to the aforementioned paper-based piece. In this instance, the avoidance of a direct seal between the plastic and the one or more paper-based pieces allows for greater flexibility in recycling. This embodiment allows for a design that avoids paper/fiber contamination as the sealing mechanism occurs between the paper cards and not between the plastic and the card.

As used in the specification and claims, de-constructable is defined as a package that can be separated into suitable paper and plastic portions and then optionally be recycled via normal waste collection means. Recycleable is defined as a package recycled via normal waste collection means. Clamshell is a type of packaging design that is known to those of skill in the art. As used in conjunction with the present invention, suitable paper-based materials include, but are not limited to, paper, cardboard, cardstock, fluted card stock, fluted cardboard, corrugated card stock, fluted cardboard or any other product formed using paper/wood product as the starting material. Plastic or plastic-based materials suitable for use in conjunction with the present invention include, but are not limited to, products made from polymers. Examples of suitable plastic polymers include, but are not limited to, polypropylenes (PP), polystyrenes (PS), high impact polystyrenes (HIPS), polyethylene terephthalates (PET), poly(vinyl chlorides) (PVC), polyurethanes (PU), polycarbonates (PC), polyvinylidene chlorides (PVDC) and polyethylenes (PE). Due to the nature of product display, most embodiments will employ a transparent or translucent plastic.

An additional stiffening card can be employed via the use of corrugated plastic, or even paper-based, insert. In one embodiment, a corrugated plastic insert is included in addition the plastic shell or inner portion. In another embodiment the profile or the blister flange itself is corrugated. This corrugated plastic allows for a substantially stiffer package and improves tamper resistance, appearance and stability.

Examples of one embodiment of a hinged package are detailed in FIGS. 1 through 6. FIG. 1 details a front exploded view of one embodiment used to display a product. While the embodiment of the drawing details light bulbs as the product, the present invention is not limited to just packaging for light bulbs, Rather any type item, or number of items, can be placed within the confines of the package. In one embodiment, package 2 is comprised of a front 6, a middle 20, and a back 10. In one embodiment, front 6 and back 10 are formed from a paper-based material, while middle 20 is formed from a plastic-based material. As can be seen from FIG. 1, middle 20 contains a one or more product portions 4 that are formed to conform to and/or hold any suitable number of objects 8 (see FIG. 3).

Regarding front 6, in one embodiment front 6 has formed therein at least one opening that is designed to permit, if so desired, a portion, or portions, of middle 20 to protrude there through. In this case, middle 20 can also be referred to as an insert in package 2 because middle 20 can be "inserted" between front 6 and back 10.

Typically the material chosen for middle 20 permits a user to visually observe product 8 contained therein. Accordingly, in one embodiment if visibility is desirable middle 20 is formed from a clear plastic, or plastic-based, material. However, middle 20 of the present invention does not always need to be formed from a translucent, clear, or optically clear plastic material. In addition, the plastic used is of an adequate thickness to prevent tampering and/or pilfering of product 8. It is understood that the particular design of product portions 4 depends upon the contents destined to be contained, or cradled therein.

FIG. 1 also details front 6. In one embodiment front 6 (also defined as the front) may be decorative and used as a way of advertising, or providing information about, product 8 contained therein. This concept is not limited to any one single advertising embodiment as an unlimited number of embodiments are possible to produce any number of packaging end designs. Front 6 can be made from any of the paper-based materials detailed above. In one embodiment, front 6 is formed from paper, cardboard, or even a plastic or plastic-based material. In still another embodiment, the paper-based materials used in the packaging of the present invention contain at least some amount of recycled paper material.

Additionally, front 6 can be made from a material which seals to one or more cards on at least one side (i.e card front can be made from several layers of cardstock, with an advertisement typically being on the outermost or top layer). The side for this adhesion/sealing of front 6 is not shown in FIG. 1. The non-advertisement containing side is typically used for sealing and is, in this example, the back (or second surface) of front 6. Front 6 may contain one or more optional holes or voids at or near the top of the package to allow the package to be hung from a display.

Figure 2:
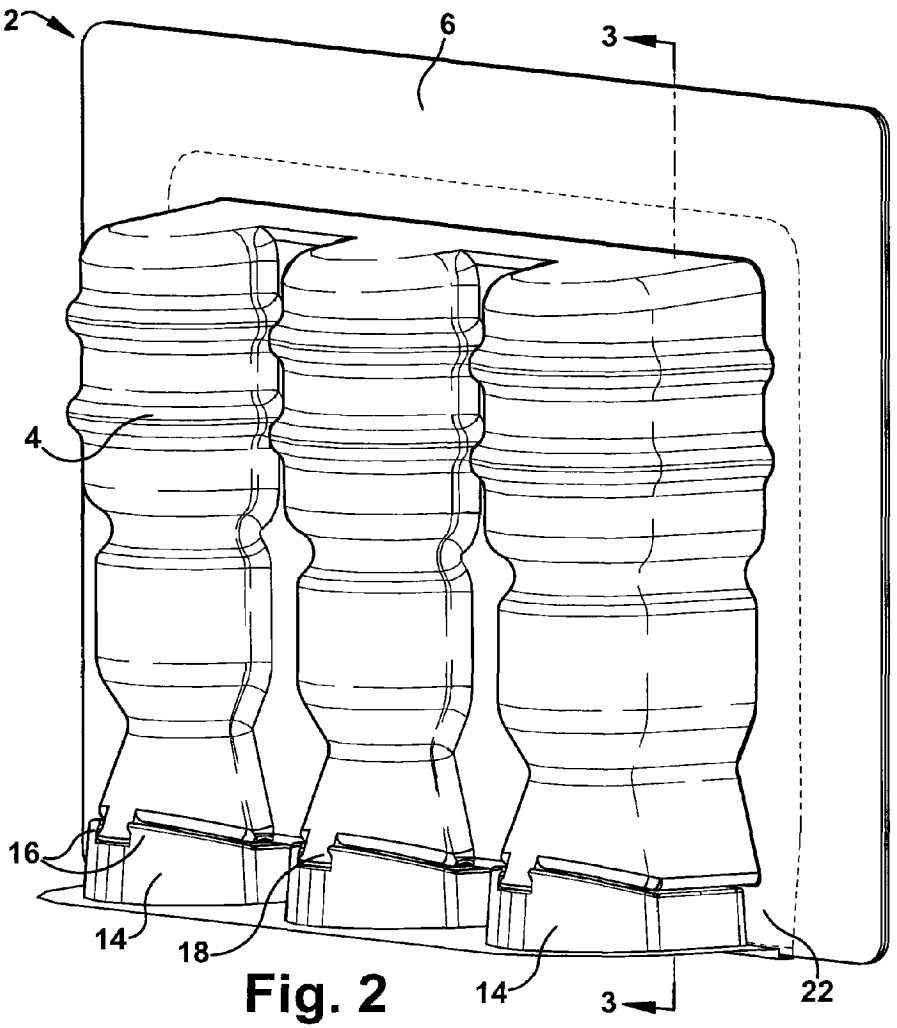
FIG. 2 is a front view of the package of FIG. 1.

FIG. 2 provides an assembled view of package 2. As such, FIG. 2 details the typical final product a consumer in a retail setting would view package 2. In this view base 14 is secured to middle 20 (also defined herein as the middle portion).

Figure 3:
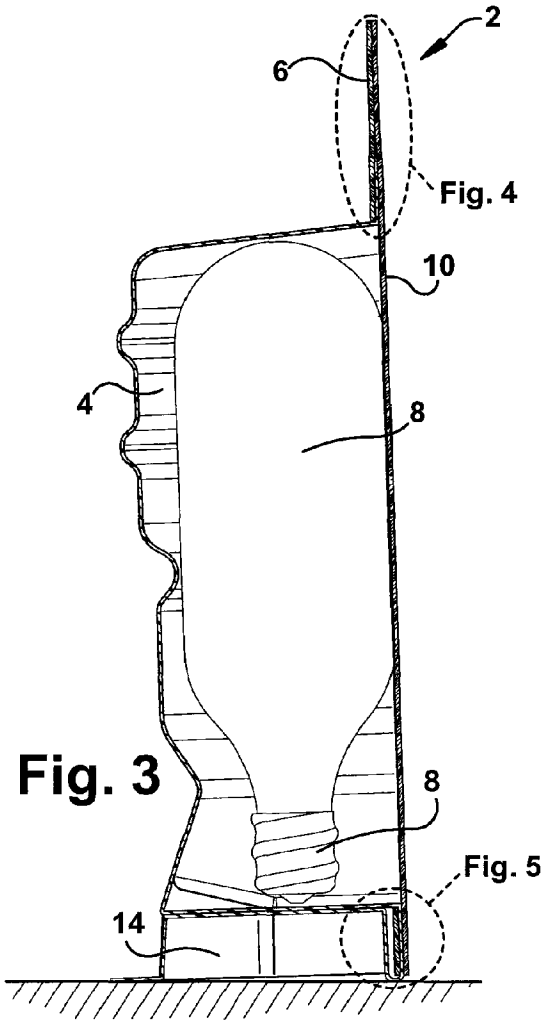
FIG. 3 is a cross-sectional view of the package of FIG. 1.

FIG. 3 provides a cutaway side profile of package 2. In order to show the various layers involved, FIG. 3 details front 6, back 10, and blister flange 12 and details the layered aspects. In a standard use such as in a retail store, these three layers are adhered/affixed/bonded to one another. In one embodiment, front 6 is secured directly to back 10 via a securing means such as, but not limited to glue, adhesive, heat activated adhesive, pressure activated adhesive, releaseable adhesive, or pressure. Releaseable adhesive is defined as an adhesive means which releases, leaving behind minimal traces of the adhesive upon one surface.

In one embodiment, the outermost edges of front 6 and back 10 are approximately the same size and shape to allow package 2 to maintain a neat and professional appearance. Front 6 and back 10 are both slightly larger than the outermost edges of blister flange 12. This setup allowing a proper seal between front 6 and back 10 and adequately securing blister flange 12. In such an embodiment front 6 and back 10 adhere to one another at the edges, essentially securing blister flange 12 in between front 6 and back 10 and ultimately securing middle 20 into place.

FIG. 3 also provides a profile view of one embodiment of base 14 of package 2. Base 14 providing adequate support for vertically displaying package 2 on a shelf, table or in a sleeved box. Base 14 providing a stable support and allowing package 2 to stand independently. One problem frequently encountered in the art involves the use of an undercut. An undercut is usually needed to facilitate release of the plastic portion from the forming mold. Such a procedure produces an unstable package which falls over as the product must lean at an angle. The base in those examples not being at a 90 degree angle to the supporting card or the base being undersized/unstable.

In one embodiment base 14 becomes a two portion continuous piece with base 14 securing or locking to the bottom of product portions 4. The size of the base 14 varies due to the product 8 used and the product portions 4 desired. In various embodiments, packages 2 displaying products 8 requiring various width bases, various height bases or various depth bases. As stated previous, base 14 being dependent on package 2 and product 8 requirements. Finally, while a circular base 14 is detailed in FIG. 2, the exact shape of base 14 may vary. The shape of base 14 may be altered due to aesthetic or functional factors.

In one embodiment back 10 contains a series of cutouts. Such a series of cutouts can be, but are not limited to perforations in the cardboard to allow a complete or partial detachment of the cutout portion of the cardboard. Such a cutout allowing for removal of one or more of the products contained therein. In another embodiment product portions 4 or middle 20 may include perforations in the plastic to allow a complete or partial detachment of the cutout portion of the plastic.

FIGS. 1 and 2 detail the locking or securing aspect described previous via a female portion 16 of base 14 and a male portion 18 of product portions 4. The exact location of female portion 16 and male portion 18 can be altered, reversed or moved according the product 8 being displayed/sold. In one embodiment a sloping surface is used to secure female portion 16 and male portion 18. Base 14 attaches or locks itself onto the bottom edge of product portions 4. Various embodiment are possible which utilize different locking mechanisms that allow a securing of the two portions. Examples include, but are not limited to, a raised cylinder and a recessed cylinder, a rectangular block with a corresponding recessed block, and any number of varying shapes and corresponding recessed areas. The locking mechanism may vary and take different forms based on the needs and requirements of the individual user. The ultimate purpose of the locking mechanism being to secure or close the package to allow display in a vertical manner. FIGS. 2 and 3 detail the package with base 14 secured to bottom edge of plastic profile 4 and allowing the package to stand independently.

Figure 4:
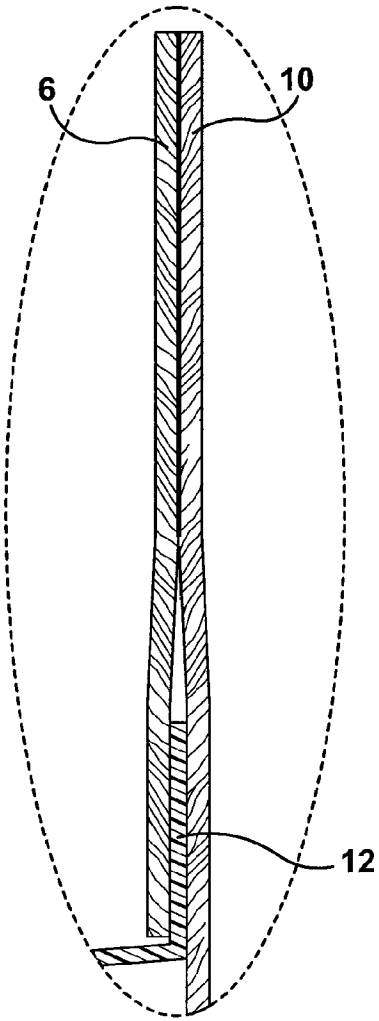
FIG. 4 is a close-up view of a portion of the package of FIG. 3.

As shown in FIG. 4 and as stated previous, package 2 contains two significant parts, the card stock referred to as front 6 and back 10 and the middle 20. Middle 20 including both the blister flange 12 and the product portions 4. FIG. 4 details the arrangement at the top edge of product portions 4. In this embodiment front 6 is directly bonded to back 10. This arrangement essentially locks in or secures blister flange 12.

Figure 6:
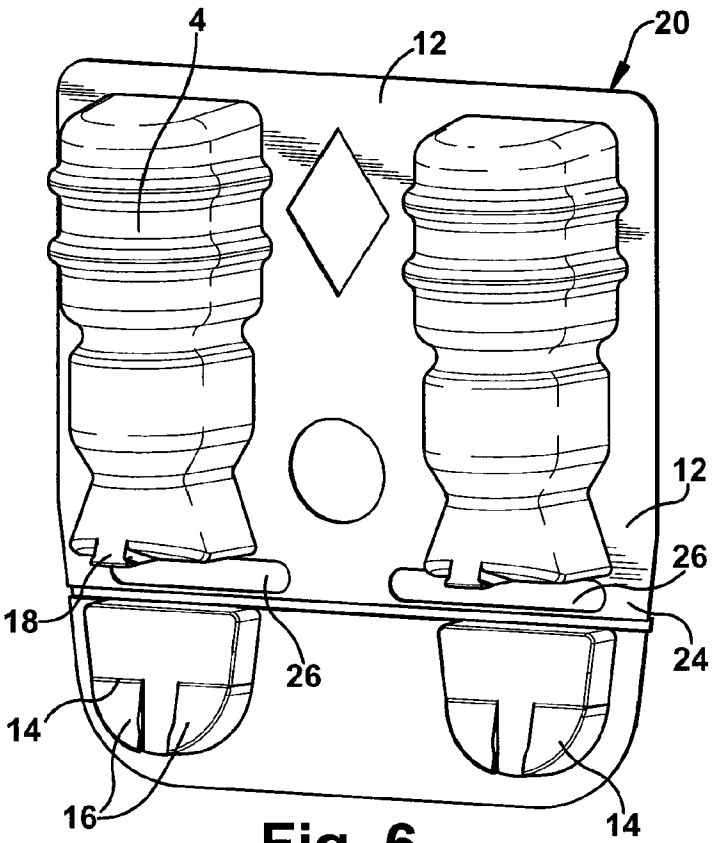
FIG. 6 is a front view of an alternative insert for use in a package in accordance with an embodiment of the present invention.
Figure 5:
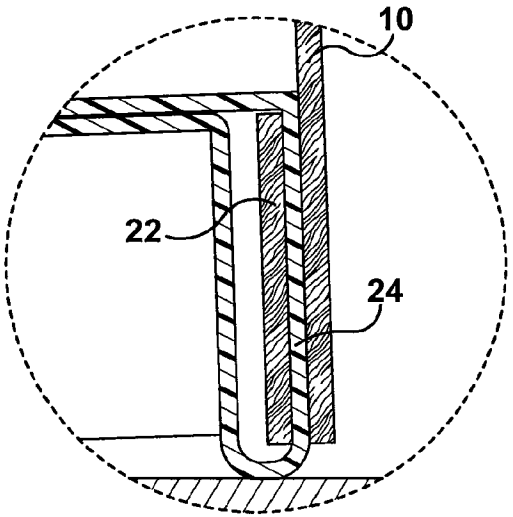
FIG. 5 is a close-up view of another portion of the package of FIG. 3.

FIG. 5 details one embodiment of the bottom of package 2. At or near the bottom of package 2, the area between base 14 and product portions 4 contains card strip 22 and plastic strip 24. Card strip 22 being a continuous narrow strip connected to front 6. Card strip 22 able to seal at one or more points to back 10. This sealing being a glue, an adhesive, a heat activated adhesive, a pressure activated adhesive, pressure or any other suitable adhering means. As shown in FIG. 6, in one embodiment plastic strip 24 is continuous with base 14, blister flange 12 and product portions 4. Plastic strip 24 in one embodiment containing one or more void spaces 26 to facilitate the securing of front 6 to back 10 via card strip 22. The continuity in this embodiment between plastic strip 24, base 14 and blister flange 12 only being broken by the optional use of void spaces or opening 26. Opening 26 in essence being a hole or void in middle 20 which allows the adequate securing of card strip 22 to back 10. In one embodiment, opening 26 also allowing base 14 to bend at the angle needed for securing.

As detailed in FIG. 6, middle 20 can be removed from the mold as one continuous piece. The entire middle 20 being designed in one plane as one flat piece. Once placed between front 6 and back 10, middle 20 can bend into the second plane needed to effect the base features of package 2. Base 14 rotates about plastic strip 24 and can be aided in this rotation via the optional plastic strip pass through 26. In one embodiment base 14 rotates from the original orientation in middle 20 plane to a 90-degree angle from its original orientation. This allows base 14 to provide support to package 2 and stand in an upright manner. Additional embodiments may employ a variety of angles and may employ various starting dimensions which provide a lateral base 14 to display package 2 in a vertical plane.

Figure 8:
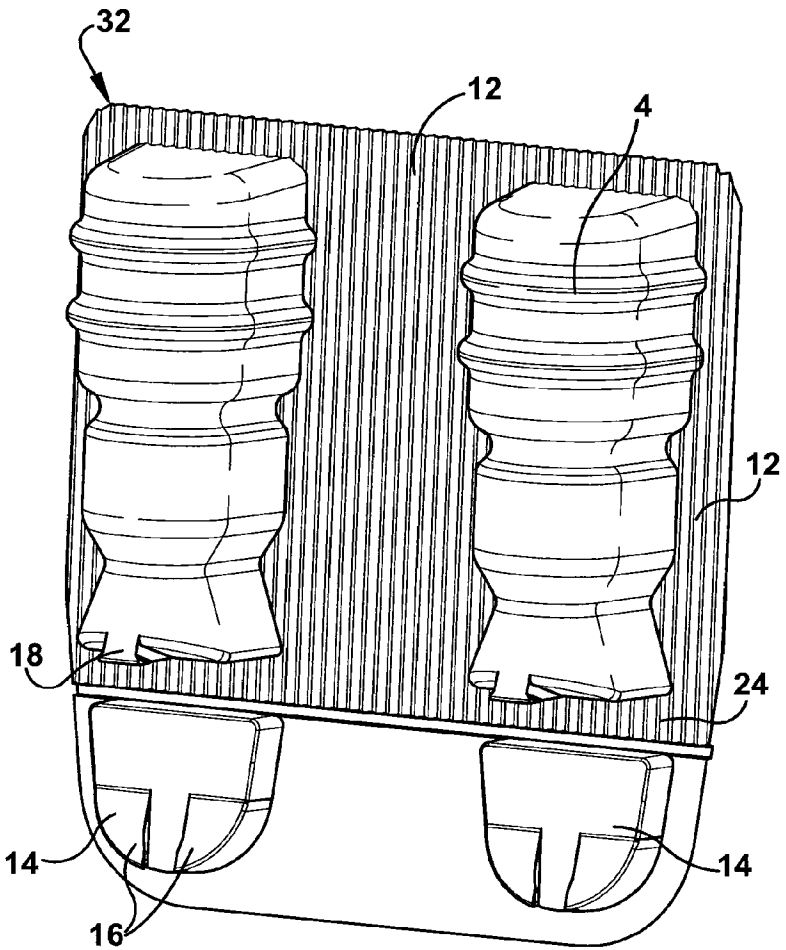
FIG. 8 is a front view of still another alternative insert for use in a package in accordance with an embodiment of the present invention.
Figure 7:
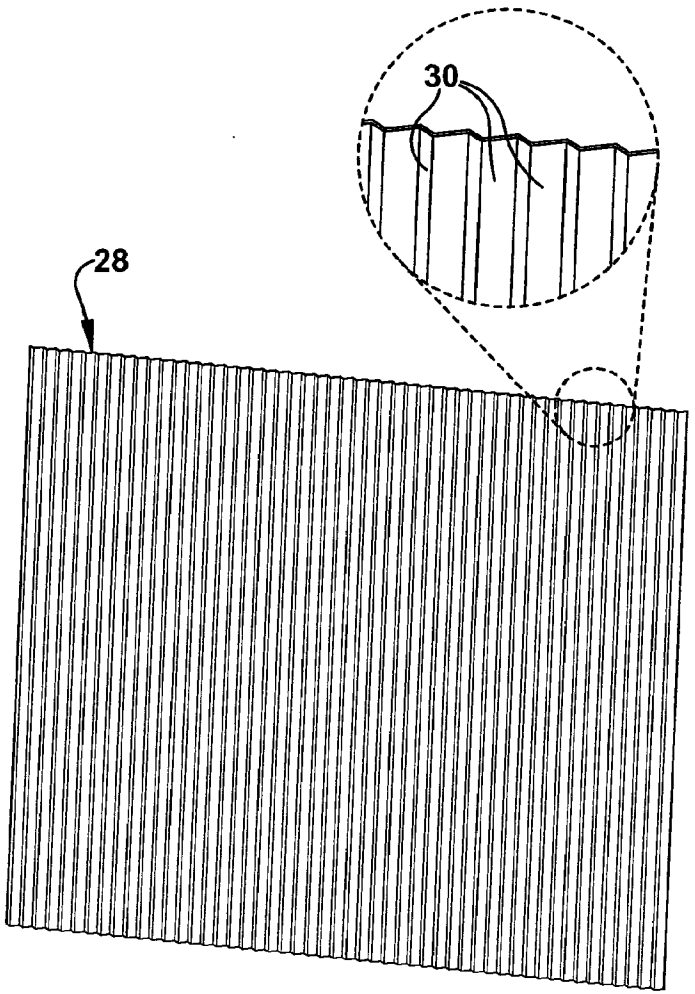
FIG. 7 is a front view of a corrugated plastic insert for use in conjunction with the a package in accordance with an embodiment of the present invention.

In order to increase the stiffness of package 2 a corrugated plastic insert 28 may be used (see FIG. 7). Corrugated plastic insert 28 providing substantial strength/stiffening to front 6 and back 10. The corrugated plastic insert 28 also providing additional tamper and pilfer resistance aspects to package 2. The corrugated aspects of corrugated plastic insert 28 can be, but are not limited to a series of ribs 30 which are semicircular, a triangular aspect, a rectangular aspect, a cross hatched pattern, a fluted aspect, or any other suitable arrangement which adds stiffness/strength to this area. In one embodiment, the corrugated portion runs to plastic insert 28 edges. Corrugated plastic insert 28 can be included as a separate insert as shown in FIG. 7 or can incorporate the corrugated aspects into blister flange 12 as shown in FIG. 8. Such a one piece corrugated plastic insert 32 being incorporated into the molding process of middle 20, including specifically blister flange 12 to provide a one piece plastic product providing the beneficial aspects of both corrugated plastic insert 28 and blister flange 12.

Embodiments needing additional vertical support benefit from the strength corrugated plastic inserts 28, 32 provide, this being especially important for allowing additional support to allow a product to stand adequately. Embodiments needing additional tamper or pilfer resistance may also benefit from the tear resistance aspects corrugated plastic insert 28, 32 provide. In one embodiment, corrugated plastic insert 32 being slightly smaller than the dimension of front 6 and back 10, allowing for proper sealing between card front 6 and card back 10. As stated previous the use of void spaces is also possible to effectuate proper adhesion. Finally the use of corrugated plastic inserts 28, 32 allowing for complete recycling of the paper portions and plastic portions of package 2.

The size aspects of the middle 20 and/or the corrugated plastic insert 28 or any combination thereof are important. In order to properly place product 8 these inserts/portions must be properly sized. One such embodiment involves using a middle 20 and/or corrugated plastic insert 28 which is nearly the same size as front 6 and back 10, with middle 20 and/or corrugated plastic insert 28 being slightly smaller to allow a seal between front 6 and back 10. Using a middle 20 and/or a corrugated plastic insert 28 nearly the same size as front 6 and back 10 allows for optimal product 8 placement as product 8 has less ability to move around as product portions 4 are properly positioned between the at least two cards. Middle 20 and/or corrugated plastic insert 28 providing additional tamper resistance and reducing potential pilfering of the package.

One advantage to using middle 20 and/or the corrugated plastic insert 28 involves the elimination of a cardboard stiffener. In instances where a cardboard stiffener is used, one can now utilize these stiffening aspects into either middle 20 or by using corrugated plastic insert 28, and thereby one or more components is removed from processing.

Although some of the features and concepts of the invention have been described in detail with particular reference to certain embodiments detailed herein, other embodiments which are within the scope of the invention can achieve the same results. Variations and modifications of the present invention which may be made by those skilled in the art are within the scope of the invention as defined by the claims and equivalents thereof.

What is claimed is:

1. A de-constructable package comprising:

a front, wherein the front is a single unbroken piece;

a back;

a base; and at least one insert, wherein the at least one insert and the base are integrally formed and further comprise at least one hinge located there between, the least one hinge connecting the base to the at least one insert, and wherein the at least one hinge yields a passageway through which a portion of the unbroken front resides and is captured when the at least one hinge is in a closed position, wherein the at least one insert has a top edge, a bottom edge, and at least one cavity, wherein the front has at least one opening and the at least one cavity protrudes through the at least one opening, wherein the base and the at least one insert together contain at least one locking mechanism, the locking mechanism having a first portion integrally formed on an outer surface of the at least one insert and a second portion integrally formed on an outer surface of the base, the first and second portions of the at least one locking mechanism being designed to operatively engage with one another, and wherein the base has a planar surface which is perpendicular to a planar surface of the insert when the locking mechanism is fully engaged, whereby the planar surface of the base provides a support for the de-constructable package wherein the planar surface of the insert is oriented vertically;

wherein the front, the back, the base and the at least one insert together form a de-constructable package, wherein the combination of the base and the at least one insert permit the de-constructable package to stand independently, wherein the front and back are formed from a paper-based material, the at least one insert is formed from a plastic-based material, and the front, the back and the at least one insert are recyclable, and wherein the paper-based material portion and the plastic-based material portion of the de-constructable package do not suffer from a substantial amount of cross-contamination by the opposing material.

2. The de-constructable package of claim 1, wherein the at least one insert is releasably located between the front and the back.

3. The de-constructable package of claim 1, wherein the back further comprises at least one opening there through and the at least one cavity protrudes through the at least one opening.

4. The de-constructable package of claim 1, wherein the front and back are secured to one another with the at least one insert being releasably located between the front and the back.

5. The de-constructable package of claim 1, wherein the front is releasably directly secured to the back with the at least one insert being releasably located between the front and the back.

6. The de-constructable package of claim 1, wherein the at least one insert further comprises at least one opening formed there through to permit the front to come into direct contact with the back.

7. The de-constructable package of claim 1, wherein the at least one insert is fluted or corrugated.

8. The de-constructable package of claim 1, further comprising a support insert which is fluted or corrugated.

9. The de-constructable package of claim 1, wherein the front, the back and the at least one insert are attached via an adhesive.

10. The de-constructable package of claim 1, wherein the back further comprises at least one removable section.

11. The de-constructable package of claim 1, wherein the at least one insert further comprises at least one removable section.

12. The de-constructable package of claim 1, wherein the first portion of the locking mechanism is a male locking mechanism and wherein the second portion of the locking mechanism is a female locking mechanism.

13. The de-constructable package of claim 1, wherein the first portion of the locking mechanism is a female locking mechanism and wherein the second portion of the locking mechanism is a male locking mechanism.

14. A de-constructable package comprising:

a front, wherein the front is a single unbroken piece;

a back;

a base; and at least one clamshell insert, wherein the at least one clamshell insert and the base are integrally formed and further comprise at least one hinge located there between, the least one hinge connecting the base to the at least one insert, and wherein the at least one hinge yields a passageway through which a portion of the unbroken front resides and is captured when the at least one hinge is in a closed position, wherein the at least one clamshell insert has a top edge, a bottom edge, and at least one cavity, wherein the front has at least one opening and the at least one cavity protrudes through the at least one opening, wherein the base and the at least one clamshell insert together contain at least one locking mechanism, the locking mechanism having a first portion integrally formed on an outer surface of the at least one clamshell insert and a second portion integrally formed on an outer surface of the base, the first and second portions of the at least one locking mechanism being designed to operatively engage with one another, and wherein the base has a planar surface which is perpendicular to a planar surface of the clamshell insert when the locking mechanism is fully engaged, whereby the planar surface of the base provides a support for the de-constructable package wherein the planar surface of the clamshell insert is oriented vertically;

wherein the front, the back, the base and the at least one insert together form a de-constructable package, wherein the combination of the base and the at least one insert are integrally formed and permit the de-constructable package to stand independently, wherein the front and back are formed from a paper-based material, the at least one insert is formed from a plastic-based material, and the front, the back and the at least one insert are recyclable, and wherein the paper-based material portion and the plastic-based material portion of the de-constructable package do not suffer from a substantial amount of cross-contamination by the opposing material.

15. The de-constructable package of claim 14, wherein the back further comprises at least one opening there through and the at least one cavity protrudes through the at least one opening.

16. The de-constructable package of claim 14, wherein the front and back are secured to one another with the at least one insert being releasably located between the front and the back.

17. The de-constructable package of claim 14, wherein the front is releasably directly secured to the back with the at least one insert being releasably located between the front and the back.

18. The de-constructable package of claim 14, wherein the at least one insert further comprises at least one opening formed there through to permit the front to come into direct contact with the back.

19. The de-constructable package of claim 14, wherein the at least one insert is fluted or corrugated.

20. The de-constructable package of claim 14, further comprising a support insert which is fluted or corrugated.

21. The de-constructable package of claim 14, wherein the front, the back and the at least one insert are attached via an adhesive.

22. The de-constructable package of claim 14, wherein the front and the back are attached via a releasable adhesive.

23. The de-constructable package of claim 14, wherein the back further comprises at least one removable section.

24. The de-constructable package of claim 14, wherein the at least one insert further comprises at least one removable section.

25. The de-constructable package of claim 14, wherein the first portion of the locking mechanism is a male locking mechanism and wherein the second portion of the locking mechanism is a female locking mechanism.

26. The de-constructable package of claim 14, wherein the first portion of the locking mechanism is a female locking mechanism and wherein the second portion of the locking mechanism is a male locking mechanism.

27. A method for forming a de-constructable package comprising:

providing a front, wherein the front is a single unbroken piece;

providing a back;

providing a base;

providing at least one insert; and securing the front, the back, the base and the at least one insert together to form a de-constructable package, wherein the at least one insert and the base are integrally formed and further comprise at least one hinge located there between, the at least one hinge connecting the base to the at least one insert, and wherein the at least one hinge yields a passageway through which a portion of the unbroken front resides and is captured when the at least one hinge is in a closed position, wherein the at least one insert has a top edge, a bottom edge, and at least one cavity, wherein the front has at least one opening and the at least one cavity protrudes through the at least one opening, wherein the base and the at least one insert together contain at least one locking mechanism, the locking mechanism having a first portion integrally formed on an outer surface of the at least one insert and a second portion integrally formed on an outer surface of the base, the first and second portions of the at least one locking mechanism being designed to operatively engage with one another, and wherein the base is perpendicular to the insert when the locking mechanism is engaged, wherein the combination of the base and the at least one insert permit the de-constructable package to stand independently, wherein the front and back are formed from a paper-based material, the at least one insert is formed from a plastic-based material, and the front, the back and the at least one insert are recyclable, and wherein the paper-based material portion and the plastic-based material portion of the de-constructable package do not suffer from a substantial amount of cross-contamination by the opposing material.

* * * * *